US005964415A

United States Patent [19]

Hadar

[11] Patent Number: 5,964,415

[45] Date of Patent: Oct. 12, 1999

[54] PORTABLE WATER—MIXTURE DISPENSER

[75] Inventor: Yoram Hadar, Natania, Israel

[73] Assignee: Lego Irrigation Ltd., Natania, Israel

[21] Appl. No.: 08/850,103

[22] Filed: May 1, 1997

[30] Foreign Application Priority Data

May 28, 1996 [IL] Israel ..... 118461

[51] Int. Cl.[6] ..... B05B 7/26

[52] U.S. Cl. ..... 239/317; 239/391; 239/581.1

[58] Field of Search ..... 239/310, 312, 239/317, 318, 315, 316, 390–3, 436, 442, 581.1

[56] References Cited

U.S. PATENT DOCUMENTS

| | | | |
|---|---|---|---|
| 2,536,361 | 1/1951 | Flanders | 239/310 |
| 2,965,309 | 12/1960 | Parrott | 239/310 |
| 3,112,884 | 12/1963 | Gilmour . | |
| 3,191,869 | 6/1965 | Gilmour | 239/318 |
| 3,447,753 | 6/1969 | Proctor et al. . | |
| 3,669,148 | 6/1972 | Burkhalter et al. . | |
| 3,770,205 | 11/1973 | Proctor et al. . | |
| 3,933,179 | 1/1976 | Hechler . | |
| 4,303,201 | 12/1981 | Elkins et al. | 239/383 |
| 4,315,601 | 2/1982 | Brooker et al. . | |
| 4,349,157 | 9/1982 | Beiswenser et al. . | |
| 4,369,921 | 1/1983 | Beiswenser et al. . | |
| 4,508,272 | 4/1985 | Thompson | 239/318 |
| 4,572,235 | 2/1986 | Katzer et al. . | |
| 4,653,691 | 3/1987 | Grime | 239/311 |
| 4,785,850 | 11/1988 | Sanchez . | |
| 4,811,900 | 3/1989 | LaRosa et al. . | |
| 4,901,923 | 2/1990 | McRoskey et al. . | |
| 4,903,897 | 2/1990 | Hayes | 239/394 |
| 5,183,206 | 2/1993 | Gavin | 239/317 |
| 5,615,837 | 4/1997 | Roman | 239/530 |
| 5,772,121 | 6/1998 | Wang | 239/394 |

FOREIGN PATENT DOCUMENTS

| | | |
|---|---|---|
| 0375000 | 6/1990 | European Pat. Off. . |
| 8626622 | 1/1987 | Germany . |
| 2137902 | 10/1984 | United Kingdom . |

*Primary Examiner*—Andres Kashnikow
*Assistant Examiner*—Lisa Ann Douglas

[57] ABSTRACT

A portable water-mixture dispenser includes a housing having a manually-grippable handle, a container carried by the handle for containing a substance to be selectively mixed with the water when discharged from the housing outlet, and a control valve within a control chamber in a connecting passageway communicating with an inlet port of the container. The control valve is manually presettable to: (a) a first position to steer the water from the housing inlet directly to the housing outlet; (b) a second position to steer the water from the housing inlet to the container inlet port; or (c) a third position to block the flow of water from the housing inlet to both the container inlet port and the housing outlet.

19 Claims, 6 Drawing Sheets

FIG. 1
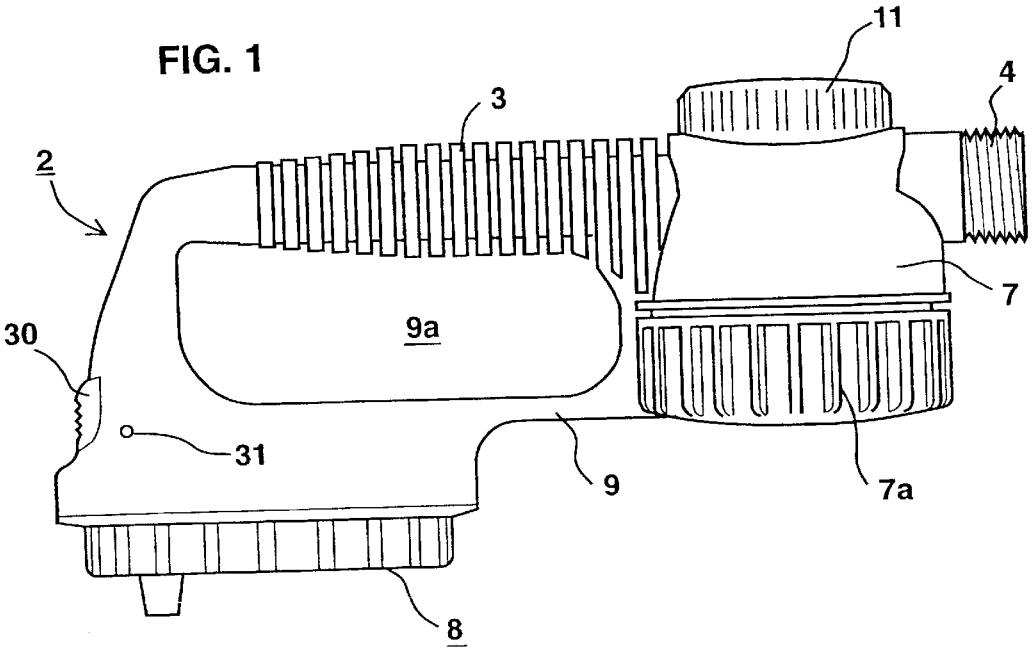
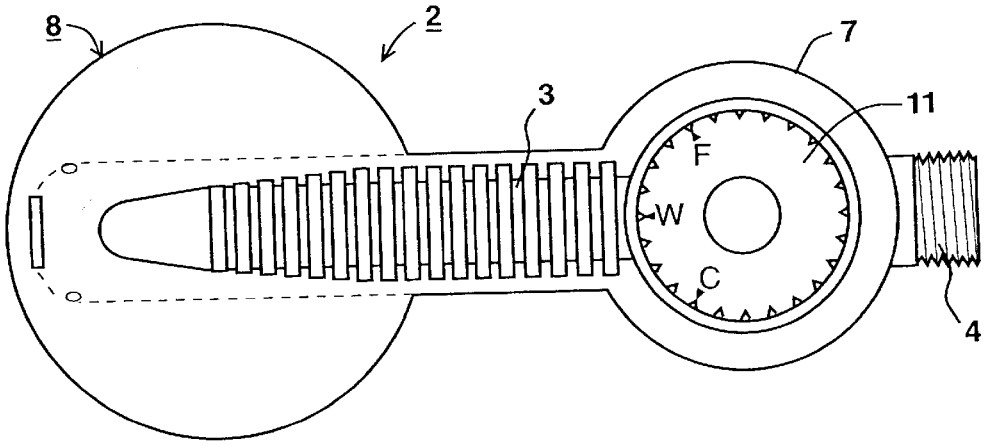
FIG. 2

PORTABLE WATER— MIXTURE DISPENSER

FIELD AND BACKGROUND OF THE INVENTION

The present invention relates to a portable water-mixture dispenser, and particularly to one which may be used for a wide variety of applications, such as by amateur gardeners for dispensing fertilizer, herbicides or other substances, or by the general public for washing vehicles, animals, kitchen utensils, etc.

Many different types of portable water-mixture dispensers are known for different applications. An object to the present invention is to provide a novel portable water-mixture dispenser construction which permits the same dispenser to be selectively used for many different applications. Another object is to provide a dispenser which is constructed of a relatively few simple parts that can be produced and assembled in volume and at low cost.

BRIEF SUMMARY OF THE INVENTION

According to the present invention, there is provided a portable water-mixture dispenser comprising: a housing including a manually-grippable handle having a housing inlet connectable to a source of water, a housing outlet for discharging the water, and a connecting passageway connecting the inlet to the outlet; a container carried by the handle for containing a substance to be selectively mixed with the water when discharged from the housing outlet, the container having an inlet port leading from the connecting passageway into the interior of the container, and an outlet port leading from the interior of the container back to the connecting passageway; a control chamber in the connecting passageway communicating with the container inlet port; and a control valve within the control chamber manually presettable to: (a) a first position to steer the water from the housing inlet directly to the housing outlet; (b) a second position to steer the water from the housing inlet to the container inlet port; or (c) a third position to block the flow of water from the housing inlet to both the container inlet port and the housing outlet. The handle is hollow and defines a major portion of the connecting passageway. The container is carried at one end of the handle and has a central axis substantially perpendicular to the handle, and the housing outlet is located at the opposite end of the handle. The dispenser further includes a water discharge head attached to the housing outlet and has a central axis substantially parallel to that of the container.

According to further features in the described preferred embodiment, housing inlet is at one end of the handle, and the housing outlet is at the opposite end of the handle. The container is carried at the end of the handle adjacent to the housing inlet, and is joined to the opposite end of the handle having the housing outlet by a housing section formed with an enlarged opening for receiving the fingers of the user when manually gripping the handle.

According to further features in the described preferred embodiment, there are a plurality of different water discharge heads each selectively attachable to the housing.

As will be described more particularly below, such a dispenser can be produced in volume and at low cost, and can be used for any one of a large number of different applications.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a side elevational view illustrating one form of portable water-mixture dispenser constructed in accordance with the present invention;

FIGS. 2, 3 and 4 are top, bottom and end views, respectively, of the dispenser of FIG. 1;

DESCRIPTION OF A PREFERRED EMBODIMENT

Figure 3:
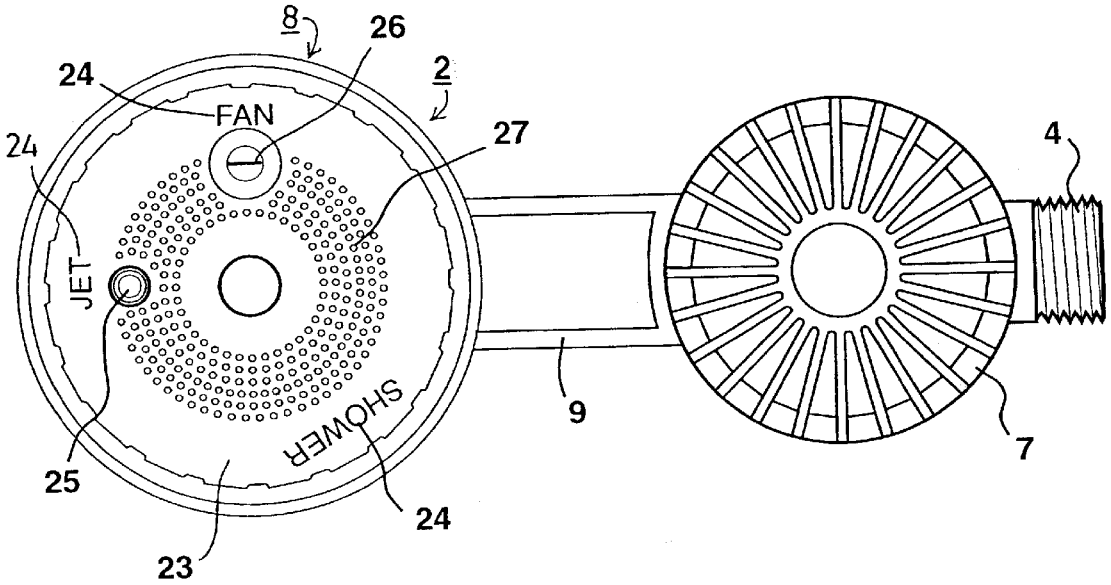
Figure 4:
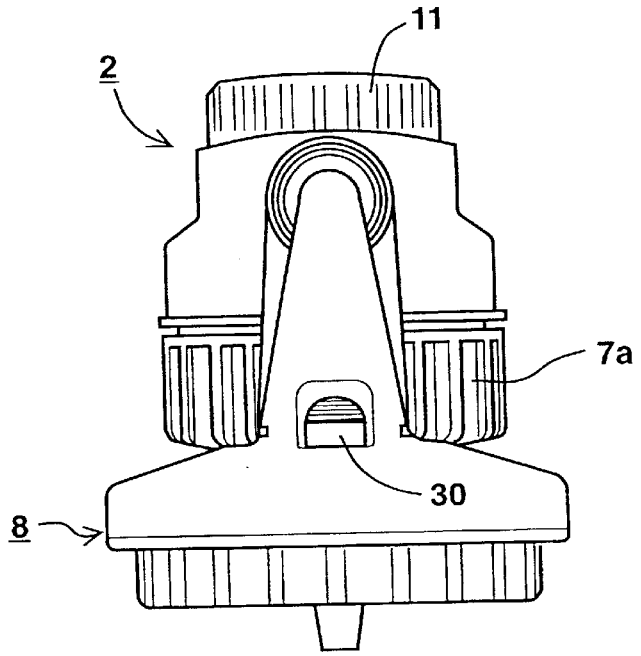
Figure 5:
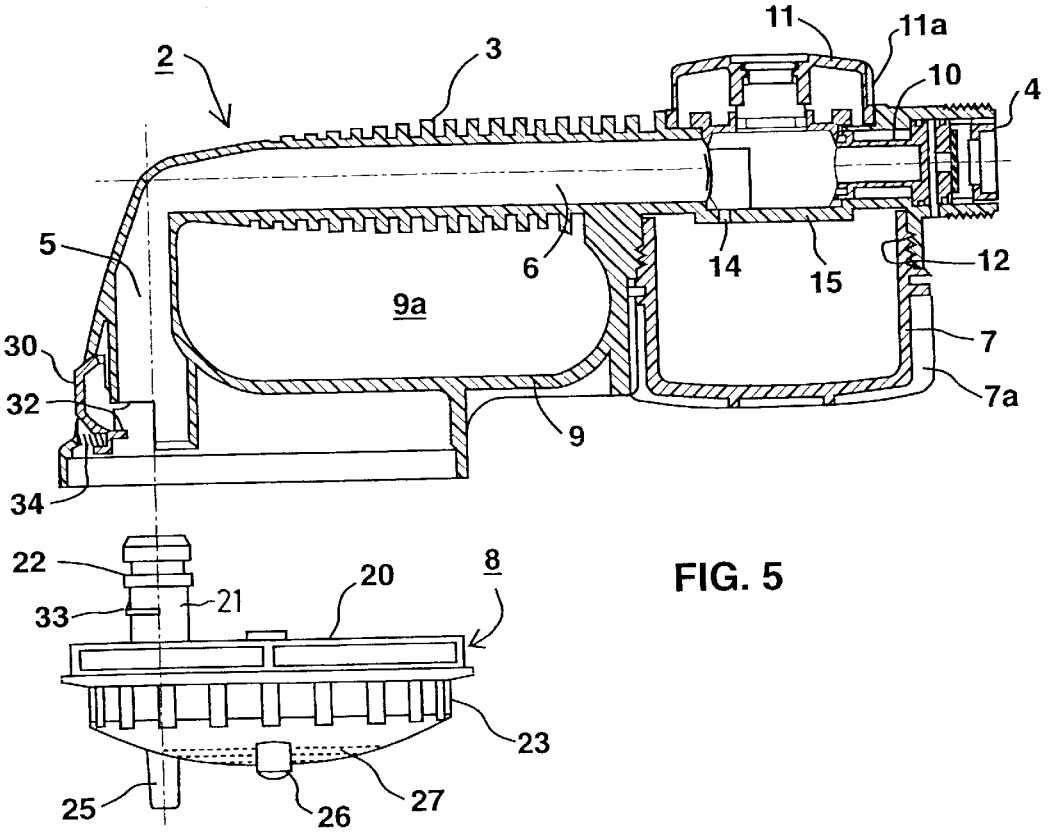
FIG. 5 is an exploded view, partly in section, of the dispenser of FIG. 1.

The portable water-mixture dispenser illustrated in FIGS. 1–7 is designed for use particularly by amateur gardeners in order to supply water to plants selectively with or without an additive, such as a fertilizer or herbicide. It also supplies the water according to a selected one of three water discharge patterns, namely a "jet" discharge, a "fan" discharge, or a "shower"discharge. Such a portable dispenser would preferably be provided with a plurality of interchangeable discharge heads, as illustrated for example in FIGS. 8–11, to further widen the possible uses of the dispenser.

The dispenser illustrated in FIGS. 1–7 includes a housing, generally designated 2, formed with a manually grippable handle 3. One end of housing 2 includes an inlet 4 connectable to a source of water (not shown), and the opposite end of the housing includes an outlet 5 (FIG. 5) for discharging the water. Handle 3 is hollow and defines the major portion of the connecting passageway 6 between inlet 4 and outlet 5.

The inlet end of housing 2 mounts a container 7 for a substance (e.g. fertilizer) to be selectively mixed with the water, and the opposite end mounts a water discharge head 8 quickly-attachable over housing outlet 5 to select the pattern of water to be discharged from the dispenser. The central axis of the container 7 at one end of the handle 3, and the central axis of the housing outlet 5 of the water discharge head 8 attached thereto at the opposite end of the handle, are both substantially parallel to each other, e.g., substantially perpendicular to the handle. In addition, housing section 9, between the mountings for container 7 and the water discharge head 8, is formed with an enlarged opening 9*a* for receiving the fingers of the user when manually gripping the handle 6.

Housing 2 is further formed with a chamber 10 in the connecting passageway between the housing inlet 4 and the hollow handle 6. Chamber 10 overlies and is coaxial with container 7. Chamber 10 also includes a control valve 11, presettable by a rotary knob 11*a*, both coaxial with chamber 10 and container 7.

The upper end of container 7 is formed with external threads 12 threadably received within complementary threads in housing 2. The outer surface of container 7 is preferably ribbed, as shown at 7*a*, to facilitate the application and removal of the container.

Chamber 10 includes an inlet port 13 (best seen in FIGS. 6*a*–6*c*) leading from the housing inlet 4 into the interior of container 7, and an outlet port 14 leading from the interior of the container back to passageway 6 connecting the housing inlet 4 to the housing outlet 5. Both ports 13 and 14 are formed in a wall 15 (FIG. 5) of the housing 2 closing the container 7 when attached to the housing. The inlet port 13 is oriented non-radially (e.g., tangentially) with respect to container 7, so that a swirl is imparted to the water flowing into the container, to thereby better assure mixing with the substance in the container before exiting from the container via the outlet port 14.

Figure 6A:
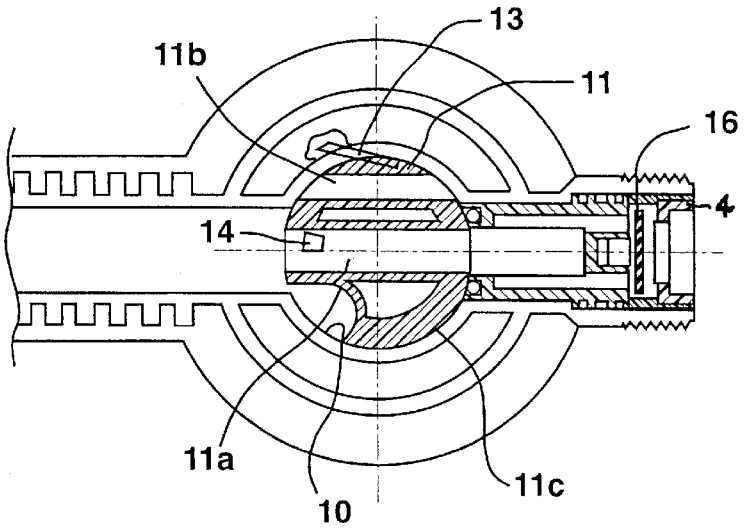
FIGS. 6*a*, 6*b* and 6*c* illustrate the three operating positions of the control valve in the dispenser of FIG. 1.
Figure 6B:
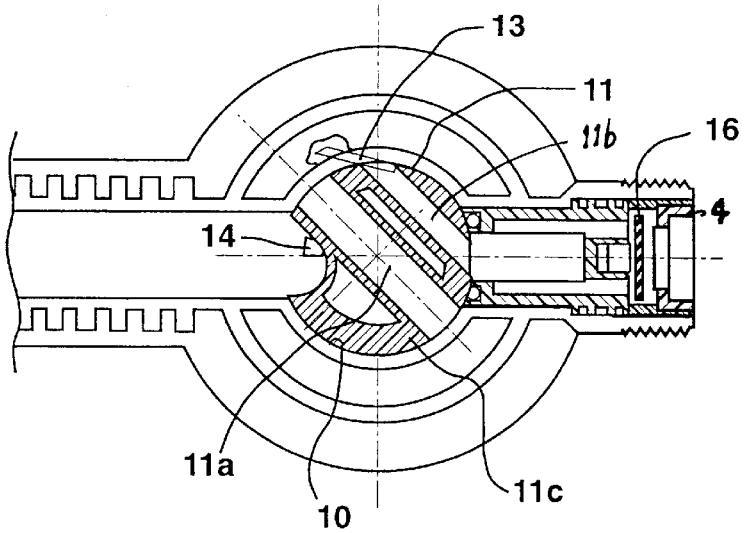
Figure 6C:
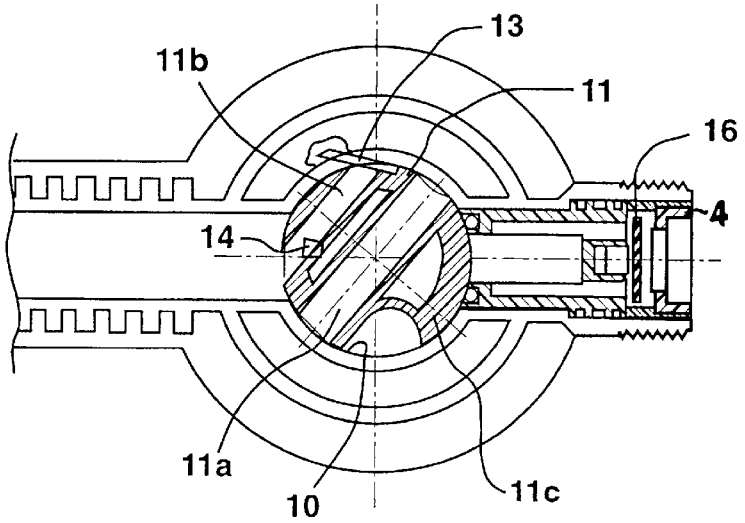

As shown particularly in FIGS. 6*a*–6*c*, rotary valve member 11 includes three operative sections defining a first flowpath 11*a* of relatively large cross-sectional area, a second flowpath 11*b* of smaller cross-sectional area, and a blocking section 11*c*. Each of the foregoing sections is selectively presettable in alignment with the housing inlet 4 by rotating knob 11, according to the indicia illustrated in FIG. 2.

In the "W" position of knob 11 as illustrated in FIG. 6*a* (also the position illustrated in FIG. 2), it aligns its flow path 11*a* with the housing inlet 4 such that it steers the water from the housing inlet directly to the housing outlet 5. Thus, the water bypasses container 7 and therefore does not become mixed wih the substance within that container.

When rotary knob 11 is rotated to the "F" position as illustrated in FIG. 6*b*, it aligns its flowpath 11*b* with the housing inlet 4 and thereby steers the inletted water to the inlet port 13 of container 7. The water entering container 7 is mixed with the substance (i.e., fertilizer) in that container, before the water is outletted via outlet port 14 to the connecting passageway 6 through handle 3 and to the housing outlet 5. Since inlet port 13 of container 10 is oriented non-radially (i.e., tangentially) with respect to the container, a swirl is imparted to the water entering the container. This better assures good mixing of the water with the substance (i.e., fertilizer) in the container, whether the substance is in solid, powder or liquid form, before the water leaves the container via the outlet port 14.

When knob 11 is rotated to the "C" position as illustrated in FIG. 6*c*, its blocking section 11*c* is aligned with the housing inlet 4, thereby blocking the flow of the water both to the container 10 and to the outlet 5.

Housing 2 further includes a one-way valve, in the form of a diaphragm 16, between the housing inlet 4 and control chamber 10. Diaphragm 16 is effective to permit the water to flow from the inlet 4 into chamber 10, but not in the reverse direction.

Figure 7:
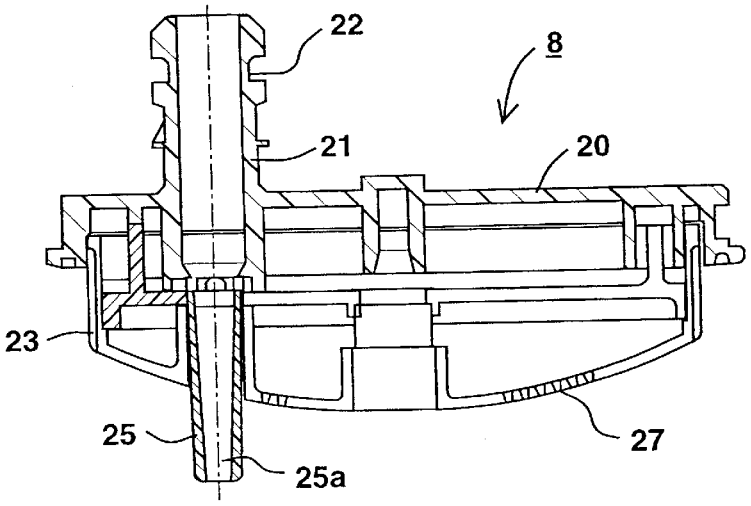
FIG. 7 is a sectional view illustrating the water discharge head in the dispenser of FIG. 1.

The water discharge head 8, as best seen in FIG. 7, includes a body member 20 of generally circular configuration. It is integrally formed at one side with a hollow stem 21 adapted to be received within housing outlet 5, which is formed as a socket for this purpose. The upper end of stem 21 includes an annular groove 22 for receiving a sealing ring (not shown) to seal the stem with respect to the outlet socket 5. Head 8 further includes a selector member 23 rotatably mounted to the body member 20 to select one of several water discharge patterns.

These water discharge patterns are indicated by indicia 24 shown in FIG. 3. Thus, selector member 23 includes a nozzle or spout 25 having an outlet passageway 25*a* of circular cross-section, to produce a "jet" discharge when the spout is aligned with the hollow stem 21. Selector member 23 further includes a nozzle 26 (FIG. 3) which has an outlet passageway 26*a* of a linear or fan-shape cross section, to produce a "fan" discharge when aligned with hollow stem 21. Selector member 23 is further formed with a plurality of relatively small apertures 27 having a common passageway (not shown) aligned with hollow stem 21 in order to produce a "shower" discharge.

Housing 2 is further provided with a retainer arrangement including a release button 30 for releasably retaining the discharge head 8 attached to the housing. Release button 30 is pivotally mounted by pivots 31 to the wall of the housing adjacent the outlet socket 5. Its lower edge is formed as a release element 32 engageable with a shoulder 33 formed on the hollow stem 21, when inserted into the outlet socket 5, for releasably retaining the discharge head attached to the housing. A spring 34 between retainer element 32 and the housing biasses the retainer element to engage shoulder 33, when hollow stem 21 is inserted into the outlet socket 5, for releasably retaining the water discharge head 8 attached to the housing.

When it is desired to remove the water discharge head, e.g. for replacement with another head, release button 30 is manually depressed at a location above its pivots 31. This causes release element 32 carried at the lower end of the button to move outwardly (clockwise, FIG. 5) out of engagement with shoulder 33 of house stem 21, thereby releasing the water discharge head for removal from the housing.

Figure 8:
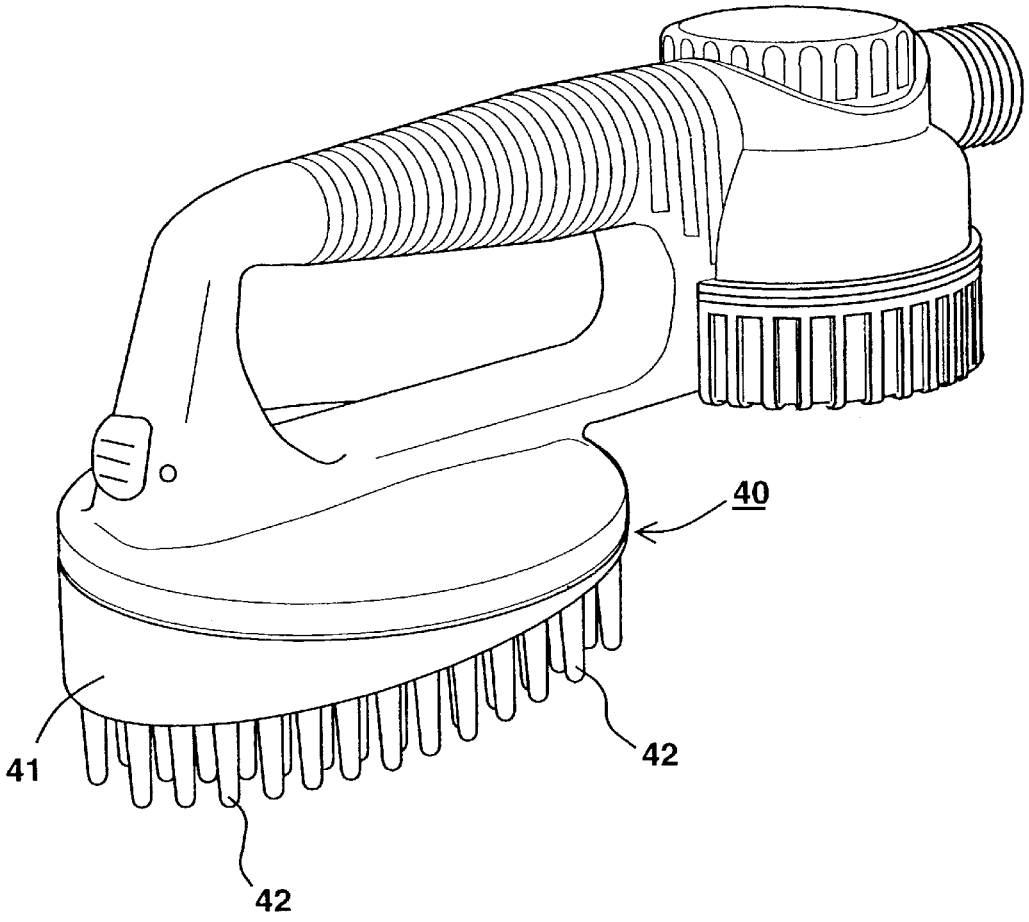
FIG. 8 is a perspective view illustrating the dispenser of FIG. 1 but with another type of water discharge head applied.
Figure 9:
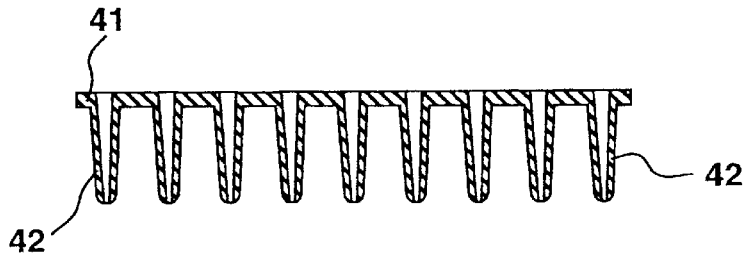
FIG. 9 is a sectional view more particularly illustrating the structure of the water discharge head in the dispenser FIG. 8.

FIGS. 8 and 9 illustrate the dispenser described above equipped with a second form of discharge head, generally designated 40. Head 40 is of the same construction as head 8 described above, i.e., including the body member 20 and the hollow stem 21 received within the outlet socket 5 of the body member 2, except that it is not provided with the rotatable selector member 23, but rather with a plural-spout member 41 as shown in FIG. 9. Thus, member 41 is made of an elastomeric material and is formed with a plurality of flexible projecting spouts 42 through which the water is discharged. This type of water discharge head as illustrated in FIGS. 8 and 9 is particularly useful for washing dogs, cats, and other animals.

Figure 10:
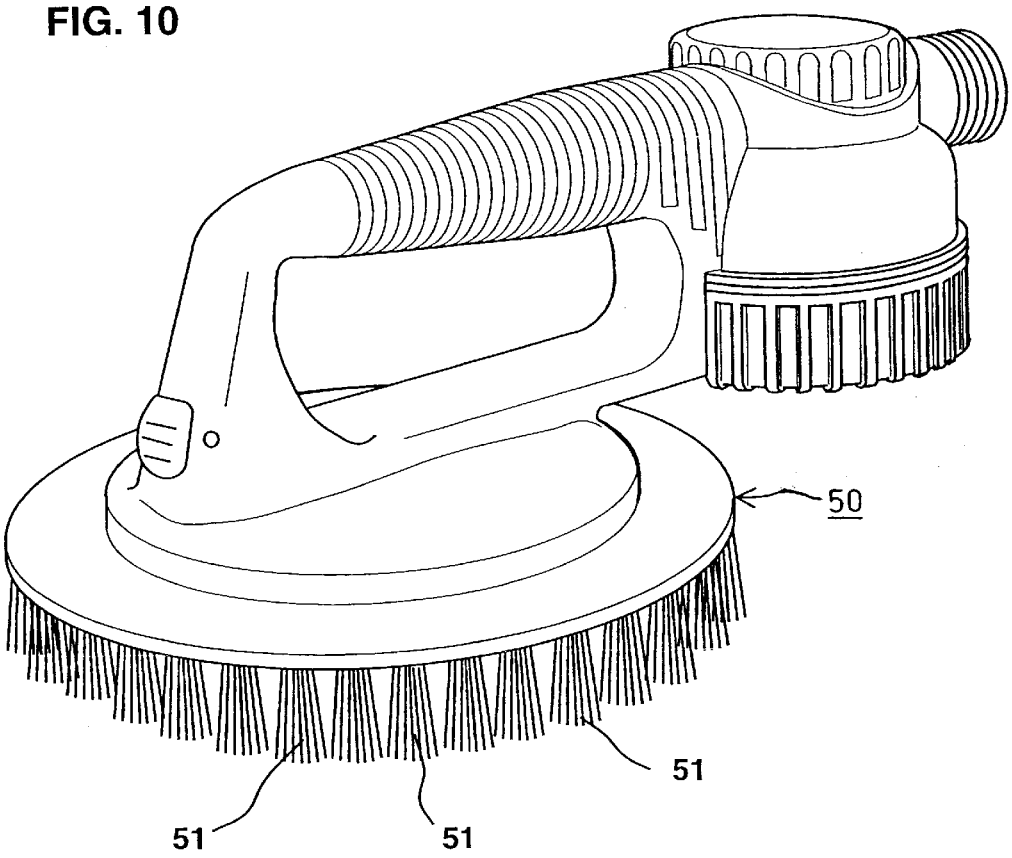
FIG. 10 is a perspective view of the dispenser of FIG. 1 but with a further type of water discharge head applied.
Figure 11:
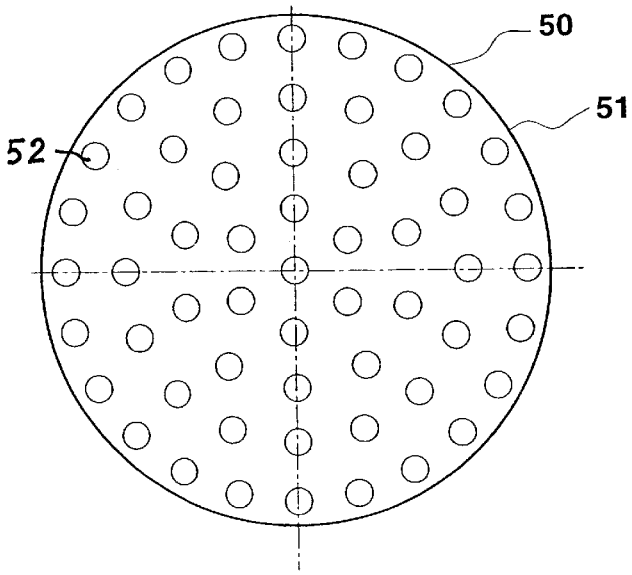
FIG. 11 is a bottom plan view of the water discharge head in the dispenser of FIG. 10.

FIGS. 10 and 11 illustrate a third type of water discharge head, generally designated 50, which may be selectively applied to the dispenser. The construction of head 50 is the same as head 40 in FIGS. 8 and 9, except that instead of the plural-spout discharge member 41, there would be included instead a bristle-type discharge member formed with a plurality of bristles 51 which are wetted via an oulet opening 52 formed in the head.

The manner of using the dispenser illustrated in the drawings will be apparent from the above description. Thus, the user first selects the type of discharge head to be used, namely head 8 of FIGS. 1–7, head 40 of FIGS. 8, 9, or head 50 of FIGS. 10, 11. Removal of a head and application of another head are done quickly by merely depressing release button 30 to release retainer element 32 (FIG. 5) from shoulder 33 in the hollow stem 20 of the head.

If head 8 of FIGS. 1–7 is applied to the dispenser, the user may rotate selector member 23 to select the desired one of the three discharge patterns illustrated in FIG. 3. The user may also preset rotary knob 11 to the "W" position illustrated in FIG. 6*a* in order to discharge only water, to the "F"

position illustrated in FIG. 6*b* to discharge fertilizer mixed with water, or to the "C" position illustrated in FIG. 6*c* to block any discharge.

While the invention has been described with respect to one preferred embodiment, it will be appreciated that this is set forth merely for purposes of example and that many variations may be made. For example, if the dispenser is to be used for washing kitchen utensils, the container 7 would contain soap rather than a fertilizer, and this would be indicated by the indicia 12. Many other variations, modifications and applications of the invention will be apparent.

I claim:

1. A portable water-mixture dispenser, comprising:

a housing including a manually-grippable handle having a housing inlet connectable to a source of water, a housing outlet for discharging the water, and a connecting passageway connecting said inlet to said outlet;

a container carried by said handle for containing a substance to be selectively mixed with the water when discharged from said housing outlet, said container having an inlet port leading from said connecting passageway into the interior of said container, and an outlet port leading from the interior of said container back to said connecting passageway;

a control chamber in said connecting passageway communicating with said container inlet port;

a control valve within said control chamber manually presettable to: (a) a first position to steer the water from the housing inlet directly to the housing outlet; (b) a second position to steer the water from the housing inlet to the container inlet port; or (c) a third position to block the flow of water from the housing inlet to both the container inlet port and the housing outlet;

said handle being hollow and defining a major portion of said connecting passageway;

said container being carried at one end of said handle and having a central axis substantially perpendicular to said handle;

said housing outlet being located at the opposite end of said handle, and a water discharge head attached to said housing outlet and having a central axis substantially parallel to that of said container.

2. The dispenser according to claim 1, wherein said container is carried at the end of said handle adjacent to said housing inlet, and is joined to the opposite end of said handle having said housing outlet by a housing section formed with an enlarged opening for receiving the fingers of the user when manually gripping the handle.

3. The dispenser according ot claim 2, wherein said chamber in said connecting passageway is coaxial with said container.

4. The dispenser according to claim 3, wherein said container is attached to said housing on one side of said chamber, and said control valve includes a rotary knob projecting from the opposite side of said chamber and coaxial with said chamber and with said container.

5. The dispenser according to claim 4, wherein said rotary knob includes a first flow path aligned with the housing inlet in said first position of the control valve and configured to steer the water from the housing inlet directly to the housing outlet; a second flow path aligned with the housing inlet in said second position of the control valve and configured to steer the water from the housing inlet to the container inlet port; and a blocking section aligned with the housing inlet in said third position of the control valve to block the water flow from the housing inlet to both the container inlet port and the housing outlet.

6. The dispenser according to claim 1, wherein said container inlet port is oriented non-radially with respect to said container to impart a swirl to the water inletted into said container.

7. The dispenser according to claim 1, wherein said housing further includes a one-way valve in said connecting passageway betwen said housing inlet and said control chamber permitting water flow in the direction from said housing inlet to said control chamber but blocking water flow in the reverse direction.

8. The dispenser according to claim 1, wherein said water discharge is quickly-attachable to the housing at said housing outlet.

9. The dispenser according to claim 8, wherein said water discharge head includes a hollow stem receivable within a socket at said housing outlet, said housing including a manually-operated retainer member engageable with said hollow stem for releasably retaining it within said socket.

10. The dispenser according to claim 8, wherein said retainer member includes a button having a retainer element normally biassed by a spring into engagement with a shoulder formed in said hollow stem but movable by manual depression of said button to disengage said shoulder and thereby to permit removal of said head.

11. The dispenser according to claim 8, wherein there are a plurality of different water discharge heads each selectively attachable to said housing.

12. The dispenser according to claim 11, wherein at least one of said water discharge heads includes a plurality of bristles wetted by the discharged water.

13. The dispenser according to claim 11, wherein at least one of said water discharge heads includes a body member attachable to said housing by said quickly-attachable connector, and a selector member rotatable with respect to said body member to select one of several water discharge patterns.

14. The dispenser according to claim 13, wherein said selector member is formed with a jet discharge pattern, a fan discharge pattern, or a shower discharge pattern, each of which patterns may be selected by rotation of said selector member with respect to said body member.

15. The dispenser according to claim 12, wherein at least one of said water discharge heads is formed with a plurality of projecting spouts of flexible plastic material through which the water is discharged.

16. A portable water-mixture dispenser, comprising:

a housing including a manually-grippable handle having a housing inlet connectable to a source of water, a housing outlet for discharging the water, and a connecting passageway connecting said inlet to said outlet;

a container carried by said handle for containing a substance to be selectively mixed with the water when discharged from said housing outlet, said container having an inlet port leading from said connecting passageway into the interior of said container, and an outlet port leading from the interior of said container back to said connecting passageway;

a control chamber in said connecting passageway communicating with said container inlet port;

and a control valve within said control chamber manually presettable to: (a) a first position to steer the water from the housing inlet directly to the housing outlet; (b) a second position to steer the water from the housing inlet to the container inlet port; or (c) a third position to block the flow of water from the housing inlet to both the container inlet port and the housing outlet;

said container being carried at the end of the handle adjacent to said housing inlet, and being joined to the opposite end of said handle having said housing outlet by a housing section formed with an enlarged opening for receiving the fingers of the user when manually gripping the handle.

17. The dispenser according to claim 16, wherein said handle is hollow and defines the major portion of said connecting passageway, said housing inlet being at one end of the handle, and said housing outlet being at the opposite end of the handle and having a central axis substantially perpendicular to said handle.

18. The dispenser according to claim 17, wherein said container is attached to said housing on one side of said chamber and has a central axis substantially perpendicular to said handle, and said control valve includes a rotary knob projecting from the opposite side of said chamber and coaxial with said chamber and with said container.

19. The dispenser according to claim 18, wherein said rotary knob includes a first flow path aligned with the housing inlet in said first position of the control valve and configured to steer the water from the housing inlet directly to the housing outlet; a second flow path aligned with the housing inlet in said second position of the control valve and configured to steer the water from the housing inlet to the container inlet port; and a blocking section aligned with the housing inlet in said third position of the control valve to block the water flow from the housing inlet to both the container inlet port and the housing outlet.

* * * * *